United States Patent [19]

Ogawa

[11] 4,073,086

[45] Feb. 14, 1978

[54] VEHICLE TOY

[75] Inventor: Iwakichi Ogawa, Kashiwa, Japan

[73] Assignee: Takara Co., Ltd., Tokyo, Japan

[21] Appl. No.: 694,134

[22] Filed: June 9, 1976

[51] Int. Cl.[2] ..... A63H 23/10; A63H 27/12

[52] U.S. Cl. ..... 46/91; 46/249; 46/206; 46/250; 46/96

[58] Field of Search ..... 46/91, 93, 96, 201, 46/249, 202, 250, 251

[56] References Cited

U.S. PATENT DOCUMENTS

| | | | |
|---|---|---|---|
| 2,949,697 | 8/1960 | Licitis et al. | 46/269 |
| 3,058,261 | 10/1962 | Lakin | 46/201 |
| 3,337,985 | 8/1967 | Ryan et al. | 46/260 |
| 3,477,173 | 11/1969 | Mabuchi | 46/93 |

FOREIGN PATENT DOCUMENTS

| | | | |
|---|---|---|---|
| 960,860 | 1/1975 | Canada | 46/96 |

*Primary Examiner*—Louis G. Mancene
*Assistant Examiner*—Robert F. Cutting
*Attorney, Agent, or Firm*—Joseph W. Price

[57] ABSTRACT

An amphibious toy such as a marine helicopter assembly is provided. The toy assembly includes a transparent spherical cockpit that is rotatively mounted on a fuselage and driven by a pivotal transmission gear assembly. A removable motor can be mounted in the fuselage to rotate the spherical cockpit about an axis transverse to the longitudinal plane of the fuselage. Alternatively, the motor can be mounted with a propeller and positioned on the outside of the fuselage for driving the toy through the water when appropriate floats are positioned on the fuselage. As a further alternative embodiment, the fuselage can take the form of a yoke for mounting the motor with a propeller to simply drive the spherical cockpit through the water.

23 Claims, 6 Drawing Figures

VEHICLE TOY

BACKGROUND OF THE INVENTION

1. Field of the Invention

The present invention is directed to a mobile vehicle toy and more particularly to an amphibious toy that may be divided into individual subcomponent toys.

2. Description of the Prior Art

The prior art has provided numerous configurations of aquatic toys. In addition, countless numbers of land vehicle toys have also been suggested. Generally, amphibious toys have not been produced due to the design problems of accommodating the toys to the environment of both water and land.

An example of some aquatic toys can be found in U.S. Pat. No. 3,246,419 and U.S. Pat. No. 3,225,491. The latter patent is of interest in disclosing a device utilizing a paddling mechanism.

In addition, the prior art has provided simulated toy aircraft which at times provided rotatable semi-spherical canopies for gun mounts on bomber toys.

Generally, the prior art has not been successful in providing an operative amphibious toy that can be divided into independent sub-toy assemblies while creating the illusion of an operator controlled or manipulation of the toys for the child.

SUMMARY OF THE INVENTION

The present invention is directed to a mobile toy incorporating a unique and versatile driving mechanism and more particularly to an amphibious toy.

The mobile toy includes a body member, such as a fuselage of a helicopter, having appropriate mounting means on either side of the body structure. A rotatable drive member such as a substantially spherical cockpit can extend substantially across the width of the fuselage and be rotatively mounted in the mounting assembly. A removable motor can be inserted into the fuselage to rotate the drive member with a power contact directly to the surface of the rotatable drive member intermediate of its mounting in the mounting assemblies.

In operation, the spherical cockpit or drive member will rotate relative to the fuselage about an axis relatively transverse to the plane of the longitudinal axis of the fuselage. The spherical cockpit can include a pivotal chair that is capable of remaining relatively stationary as the cockpit rotates, thus creating the illusion of operator control. A helicopter blade can be rotated through the same pivotal gear transmission which contacts and drives gear teeth circumferentially mounted on the spherical cockpit.

Finally, the motor is mounted within a waterproof casing and can be removed from the interior of the fuselage and fitted with a propeller to be mounted on the exterior of the fuselage for driving the marine helicopter in the water.

The features of the present invention which are believed to be novel are set forth with particularly in the appended claims. The present invention, both as to its organization and manner of operation, together with further objects and advantages thereof, may best be understood by reference to the following description, taken in connection with the accompanying drawings.

DESCRIPTION OF THE PREFERRED EMBODIMENTS

The following description is provided to enable any person skilled in the toy industry to make and use the invention and it sets forth the best mode contemplated by the inventor of carrying out this invention. Various modifications, however, will remain readily apparent to those skilled in the above art, since the generic principals of the present invention have been defined herein specifically to provide a relatively economical and easily manufactured amphibious toy assembly.

Figure 1:
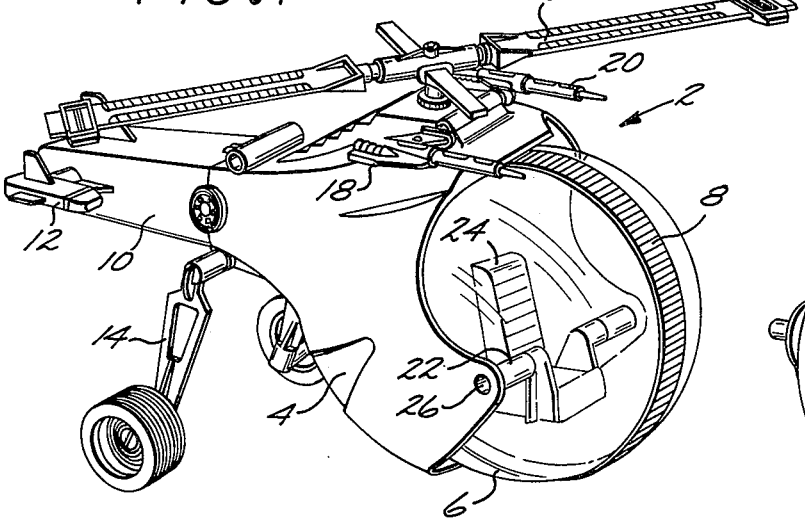
FIG. 1 is a perspective view of a marine helicopter embodiment of the present invention.
Figure 2:
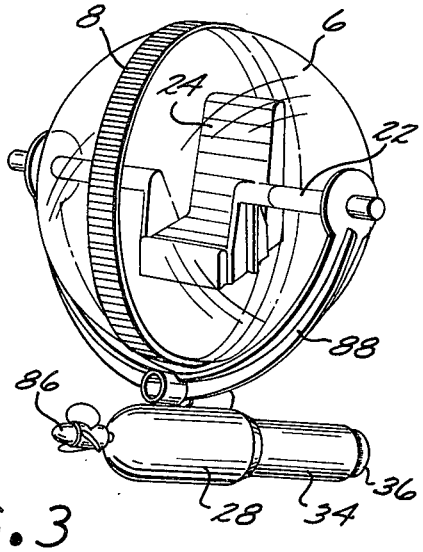
FIG. 2 is a perspective view of an alternative embodiment of the present invention.

Referring to FIG. 1, an amphibious marine helicopter toy assembly is disclosed and illustrates one possible embodiment of the present invention. The marine helicopter 2 includes a body of fuselage 4 which rotatively supports a spherical cockpit 6. As will be subsequently appreciated, the cockpit 6 need not be spherical but could assume a cylindrical or other configuration that is suitable for driving a toy assembly. As shown, the spherical cockpit 6 comprises a pair of translucent half shells that join with an overlapping fitting that forms a circumferential rib. A resilient band 8 has an internal annular groove, as seen in FIG. 2, that is capable of capturing the ribs of the half shells and assist in retaining them together. The exterior of the resilient band 8 is molded to provide gear teeth. The resilient band 8 can be molded of rubber.

Also connected to the fuselage 4 is a tail member 10 that can be fastened by a snap joint configuration. The tail member 10 includes a pair of mounting posts (not shown) which in the embodiment of FIG. 1 are mounting tail wings 12. A pair of removable wheel struts 14 can be mounted directly on the fuselage 4. A helicopter blade 16 can be rotatively mounted on the top of the fuselage 4 as will be described subsequently. Finally, as an ornamental feature, a pair of simulated guns 18 and 20 can also be removably mounted on the fuselage 4.

Figure 3:
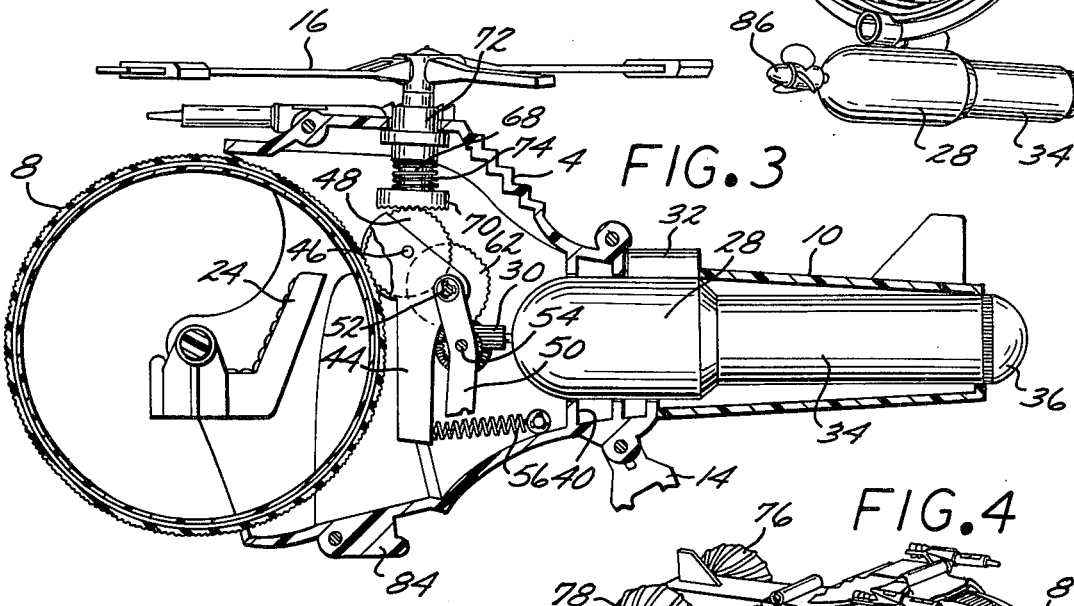
FIG. 3 is a cross-sectional view of the marine helicopter of FIG. 1.

Referring more specifically to FIGS. 2 and 3, each of the cockpit half shells includes a radially inwardly projecting mounting post 22. The mounting post 22 is hollow and terminates in a shoulder surrounding a circular mounting pin for pivotally receiving an operator chair 24. The mounting post 22 has an enlarged outer opening adjacent to the surface of the semi-spherical shell and a smaller extended diameter bore extending throughout the remaining length of the mounting post 22. The enlarged diameter portion receives an inwardly extending open cylindrical mounting post 26 extending inward from the fuselage 4.

The translucent characteristic of the cockpit 6 and the pivotal mounting of the operator chair 24, are designed to create the illusion of an operator control for the child. In this regard, a proportionately shaped doll figure can be secured to the operator chair 24 and will remain in a relatively stable position even as the spherical cockpit 6 rotates in driving the marine helicopter 2. In this regard, the operator chair 24 can be appropriately weighted to overcome any frictional forces between its mounting on the cockpit mounting post 22. Advantageously, the proportionate size of the marine helicopter 2 assembly and its individual subcomponents such as the spherical cockpit 6 are designed to be complimentary with another line of accessory toys wherein the operator doll can be a central character.

Referring specifically to FIG. 3 the operation of the marine helicopter 2 as a land vehicle can be seen. In this regard, a waterproof encased motor 28 is removably mounted within the fuselage 4. The shape of the fuselage can be subjectively varied within the parameters of our invention. A drive shaft extends forward of the motor 28 and terminates in a pinion gear 30. Extending upward from the waterproof motor 28 is an alignment post 32 that is designed to be positioned within an alignment slot on the fuselage 4. Attached to the waterproof motor 28 and likewise waterproofed is a battery storage chamber 34 which terminates in a switch 36. The tail member 10 extends over the motor 28 and battery storage chamber 34 and is dimensioned to permit an external manipulation of the switch 36. The fuselage 4 in the embodiment of FIG. 3 also includes a plurality of annular alignment ribs 40 that assist in positioning the motor pinion gear 30 in an appropriate operative position relative to the power train 42. The motor means lies within a plane containing, for definition of our description, the longitudinal axis of the fuselage member, regardless of the shape of the fuselage member.

Figure 6:
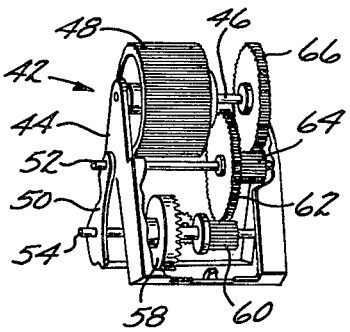
FIG. 6 is a perspective view of the gear train of the marine helicopter.

The power train 42 can be seen in more detail in FIG. 6 and includes a pivotal housing 44 that carries the relatively wide drive or spur gear 48 on the power shaft 46. A stationary mounting bracket 50 is connected to the fuselage 4 through the spindles 52 and 54. The housing 44 is biased towards the rear of the fuselage 4 along the longitudinal axis of the fuselage by the spring 56. When the waterproof motor 28 is appropriately aligned within the fuselage 4, the motor pinion gear 30 engages a crown gear 58 that drives the spindle 54 and the pinion gear 60. The pinion gear 60, in turn drives a first gear 62 which, along with the pinion gear 64, is mounted on the spindle 52. The pinion gear 64, in turn drives a second gear 66 that is mounted on the power shaft 46 along with the drive gear 48. Due to the pivotal mounting of the gear housing 44 on the spindle 52, the power shaft 46 and the drive gear 48 can rotate about the spindle 52 within the fuselage 4. This rotation does not affect the position of the crown gear 58 and accordingly, the crown gear 58 is always receptive for meshing with the motor pinion gear 30.

By providing the pivotal mounting of the power train 42, the marine helicopter assembly 2 can receive the mounting of the spherical cockpit 6 with a minimum amount of problems. When the spherical cockpit 6 is mounted as disclosed in FIG. 3, the gear teeth of the resilient band 8 mesh with drive gear 48 and, in fact, force the pivotal housing 44 backward against the force exerted by the spring 56.

The helicopter blade 16 can be operatively frictionally mounting within the hollow shaft 68 attached to a drive crown gear 70. The drive crown gear 70 has radial teeth and is mounted to one side of the spur drive gear 48. The shaft 68 is rotatively mounted within a mounting collar 72 that also seats a bias spring 74 to bias the drive crown gear 70 downward for meshing with the drive gear 48 to drive the helicopter blade 16. The helicopter blade 16 can be either a single part or plurality of parts that are assembled to form an operative blade member.

In the embodiment of FIG. 1 and FIG. 3, the removable motor 28 is aligned within the fuselage 4 by the alignment post 32 so that the motor pinion gear 30 meshes with the crown gear 58. The spherical cockpit 6 is mounted within the cylindrical mounting post 26 on the fuselage 4. When so mounted for rotatable movement, the gear on the resilient band 8 mesh with the drive gear 48. When the motor 28 is activated by the switching 36, the motor pinion gear 30 drives the drive gear 48 to rotate the spherical cockpit 6.

As can be readily appreciated, by virtue of the pivotal power transmission 42, it is not necessary that the cockpit be spherical, since to a limited degree, the drive gear 48 could follow a non-spherical surface. Realistically, an alternative embodiment would maintain the cross-sectional circular configuration of the drive portion of the cockpit but may extend the width of the cockpit to form a cylinder shape. In either event the drive gear 48 will rotate the cockpit 6 to provide forward locomotion to the marine helicopter assembly 2.

In addition, the drive crown gear 70 will be driven also by the drive gear 48 to rotate the helicopter blade 16 during the forward motion.

An operator doll appropriately positioned within the operator chair 24 will be readily visible through the transparent cockpit 6 and will remain relatively stationary while the cockpit 6 rotates about the chair and the doll. This will give the appearance of a unique form of operator control to further enhance the novelty of the present toy for a child.

Figure 4:
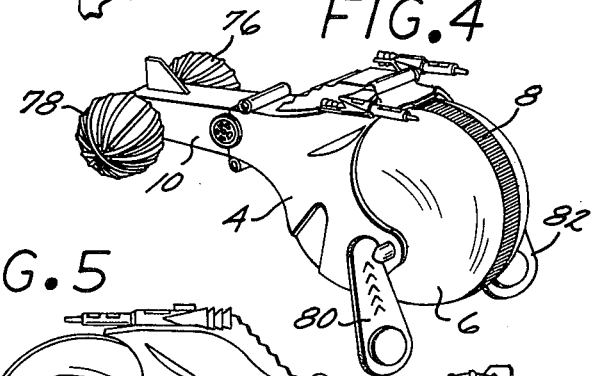
FIG. 4 is a perspective view of a modified embodiment marine helicopter.

To adapt the marine helicopter to a true amphibious operation simply requires, in the embodiment shown in FIG. 4, the inclusion of buoyancy means such as a pair of floats 76 and 78. The floats are mounted on the tail member 10 by removing the tail wing 12 and simply mounting the relative flexible floats 76 and 78 onto the mounting post (not shown) of the tail member 10. The final modification is the placement of paddles 80 and 82 within a respective cylindrical mounting post 26 on the fuselage 4. The paddles 80 and 82 are actually mounted directly onto the spherical cockpit 6 by a friction fitting within the mounting posts 22. Thus, the paddles 80 and 82 will rotate with the spherical cockpit 6 and propel the marine helicopter 2 through the water. Obviously the wheel struts 14 can be moved in this embodiment. Likewise the helicopter blade 16 can be optionally retained or removed.

Figure 5:
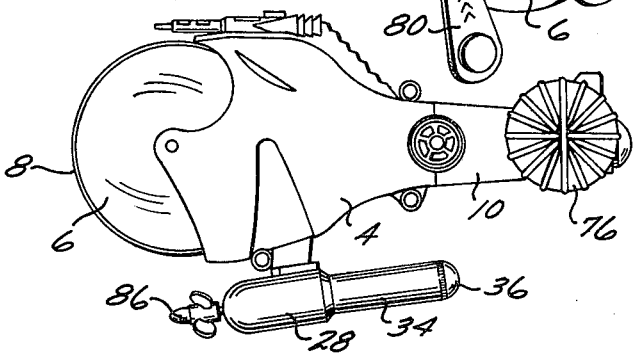
FIG. 5 is a side view of another modified embodiment of the marine helicopter.

Another marine embodiment of the present invention is disclosed in FIG. 5, wherein the waterproof motor 28 is removed from its first mounting position with the fuselage 4 and placed on a second mounting post 84 at the bottom of the fuselage 4. A propeller 86, having a hollow bore, mounts over the drive pinion gear 30 to provide power. In this embodiment the cockpit 6 does not rotate.

Still another marine embodiment of the present invention is disclosed in FIG. 2, wherein a mounting yoke 8 is directly mounted onto the mounting posts 22 of the spherical cockpit 6. Again the motor assembly 28 is mounted by its alignment post 32 onto the mounting yoke 88 and with the propeller 86, is capable of driving the spherical cockpit 6 through the water.

The mounting yoke 88 is also capable of mounting the spherical cockpit 6 onto other drive means such as a tractor assembly (not shown) or accessory items that are capable of complimenting the subcomponent parts of the present invention.

In operation a child is given a number of options to utilize the present toy assembly and at all times can utilize his imagination to the fullest due to the life-like operator control illusion created by the relatively stationary operator chair 24. Obviously other variations of the present invention are possible once a person skilled in the toy industry is aware of the generic principles embodied herein. Accordingly, the parameters of the present invention should be measured solely from the following claims.

What is claimed is:

1. A helicopter toy comprising;

a fuselage member having a first longitudinal axis;

a cockpit member connected to one end of the fuselage member;

a helicopter blade mounted on the fuselage member for relatively movement;

means for rotatively connecting the cockpit member to the fuselage whereby the cockpit member can rotate relative to the fuselage member about a second axis, and transmission means for interconnecting the rotation of the cockpit member with the helicopter blade.

2. The invention of claim 1 wherein the cockpit comprises two transparent half-shells, and means for coupling the half-shells together so they form a watertight container.

3. The invention of claim 2 wherein the coupling means includes a flexible annular resilient band.

4. The invention of claim 3 wherein the flexible resilient band has gear teeth mounted on it for operatively interfacing with the transmission means.

5. The invention of claim 1 further including a motor means capable of driving the cockpit.

6. The invention of claim 1 wherein the cockpit further includes a pivotal chair mounted within the cockpit and capable of remaining relatively stationary as the cockpit rotates.

7. The invention of claim 1 wherein means for increasing the water buoyancy of the fuselage is removably attached to the fuselage.

8. The invention of claim 1 wherein the transmission means is pivotally mounted in the fuselage and spring biased to one position for operative contact with the spherical cockpit.

9. The invention of claim 5 further including paddle members connected to the cockpit.

10. The invention of claim 1 further including a first and second motor mounting means and a removable motor assembly connected to one of the motor mounting means.

11. The invention of claim 10 wherein the first motor mounting means is within the fuselage member and the second mounting means is one the outside surface of the fuselage member.

12. The invention of claim 1 wherein the cockpit is translucent and comprises a pair of removable shells.

13. The invention of claim 1 wherein the transmission means includes a spring biased relatively movable mounting gear mounting the helicopter blade and a drive gear meshing with the mounting gear.

14. A mobile toy comprising;

a body member;

mounting means on each side of the body member;

a rotatable drive member extending substantially across and between the width of the body member and rotatively mounted in the mounting means for providing locomotion to the toy, the rotatable drive member formed of at least two removable shells connected to each other;

an annular resilient band of gear teeth removably mounted circumferentially about the rotatable drive member shells, and motor means in the body member for rotating the drive member by direct power contact with the gear teeth.

15. The invention of claim 14 further including a helicopter blade and transmission means for interconnecting the rotation of the rotatable drive member with the helicopter blade.

16. The invention of claim 14 wherein the body member is a fuselage and the drive member is a spherical cockpit.

17. The invention of claim 16 further including a resilient band of gear teeth removably mounted circumferentially about the spherical cockpit for cooperative driving contact with the transmission drive assembly.

18. The invention of claim 16 further including a pivotal transmission drive assembly interconnecting the spherical cockpit and the motor means.

19. The invention of claim 14 further including a pivotal transmission drive assembly interconnecting the drive member and the motor means, the transmission drive assembly being biased forward towards the mounting means.

20. The invention of claim 14 further including a weighted pivotal chair mounted within the drive member shells and remaining relatively stationary as the rotatable drive member rotates.

21. A mobile amphibious toy assembly comprising;

a hollow body member;

a watertight hollow rotatable drive member movably mounted adjacent one end of the body member;

a unitary motor assembly including a motor, a source of power and a watertight housing enclosing the motor and the source of power;

a first motor mounting means positioned within the interior of the body member adjacent the drive member to removably receive and retain the motor assembly;

transmission means for engaging the drive member and the motor assembly to transmit power to the drive member;

a second motor mounting means on the exterior of the body member to removably receive and retain the motor assembly, and a propeller removably attachable to the motor assembly whereby the motor assembly can be mounted in the body member to rotate the hollow drive member and also mounted on the exterior of the body member with the propeller attached to drive the toy in water.

22. The inventions of claim 21 wherein the rotatable drive member includes a pair of shells and a removable resilient band includes gear teeth, the resilient band interconnects the two shells and the gear teeth interface with the transmission means to rotate the drive member.

23. A mobile marine toy assembly comprising;

a pair of hollow hemispherical transparent members removably joined together to form a sphere;

exterior mounting means of each hemispherical member;

a yoke body member extending across and connected to each exterior mounting means;

a waterproof motor assembly means connected to and suspended from the yoke body member to provide locomotion in water;

interior mounting means adjacent the exterior mounting means in each hemispherical member, and a pivotal chair rotatively mounted within the interior mounting means and extending diametrically across the interior of the sphere, whereby the chair is adapted to receive a simulated operator toy.

* * * * *

UNITED STATES PATENT AND TRADEMARK OFFICE

CERTIFICATE OF CORRECTION

PATENT NO. : 4,073,086

DATED : February 14, 1978

INVENTOR(S) : Iwakichi Ogawa

It is certified that error appears in the above-identified patent and that said Letters Patent are hereby corrected as shown below:

Col. 1, line 59 delete "particularly" and insert --particularity--.

Col. 4, line 11 delete "switching" and insert --switch--.

Col. 4, line 53 delete "with" and insert --within--.

Col. 4, line 61 delete "8" and insert --88--.

Col. 5, line 19 delete "relatively" and insert --relative--.

Col. 5, line 56 delete "one" and insert --on--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*